United States Patent [19]

Mattingly

[11] 4,445,846

[45] May 1, 1984

[54] FLAME HOLDING LIGHTER FOR INDUSTRIAL GAS-FIRED OVENS

[76] Inventor: Owen M. Mattingly, 2241 Monocacy Rd., Baltimore, Md. 21221

[21] Appl. No.: 343,488

[22] Filed: Jan. 28, 1982

[51] Int. Cl.[3] ..... F23D 15/02

[52] U.S. Cl. ..... 431/352; 431/350; 431/351; 431/353; 48/180 A; 48/189; 239/427.3; 239/430

[58] Field of Search ..... 431/263, 350, 351, 354, 431/345, 347, 353; 48/180.1, 189.4; 239/427.3, 430

[56] References Cited

U.S. PATENT DOCUMENTS

| | | | |
|---|---|---|---|
| 65,709 | 6/1900 | Foulger et al. . | |
| 1,802,626 | 4/1931 | Boyd et al. . | |
| 2,880,792 | 4/1959 | Raskin | 431/263 |
| 2,905,235 | 9/1959 | Dolby | 431/350 |
| 3,070,153 | 12/1962 | Flynn | 431/263 |
| 3,168,133 | 2/1965 | Zoschak | 431/263 |
| 3,297,074 | 1/1967 | Murphy | 431/350 |
| 3,338,286 | 8/1967 | Haysak et al. | 158/23 |
| 3,469,791 | 9/1969 | DeLancey et al. | 431/350 |
| 3,723,050 | 3/1973 | Stevens, Jr. et al. | 431/191 |
| 3,729,287 | 8/1971 | Strashok | 431/202 |

*Primary Examiner*—Samuel Scott
*Assistant Examiner*—A. Flanigan
*Attorney, Agent, or Firm*—John F. McClellan, Sr.

[57] ABSTRACT

A flame-out-resistant portable torch for igniting gas-air blasts in industrial gas furnaces includes an inner pipe for receiving gas at one end, with the opposite end closed and a gas-expulsion slot along one side, surrounded in coaxial spacing by an outer pipe with an air-induction side slot 180° from the slot in the inner pipe, the outer pipe has air-induction butt end opening, vents around portions of it near the slots, and a flame expulsion end with anti-back-pressure structure, and the coaxial space between the inner and outer pipes has special baffles along it for gas-air mixing for better flame-retention.

3 Claims, 3 Drawing Figures

FLAME HOLDING LIGHTER FOR INDUSTRIAL GAS-FIRED OVENS

FIELD OF THE INVENTION

This invention relates generally to combustion devices and particularly to an improved flame-holding gas combustion torch.

BACKGROUND OF THE INVENTION

Patent literature has disclosed many types of torches and burners, the following U.S. Pat. Nos. being noted:

65,709, June 12, 1900, granted to E. F. L. Foulger and J. G. Glover disclosed a lighting torch inside inner and outer perforated casements;

1,802,626, Apr. 28, 1931, granted to B. K. Boyd and H. Kirsch on Apr. 28, 1931, disclosed a gas-fed fire lighter with perforated end;

3,338,286, Aug. 29, 1967, granted to K. L. Hujsak and H. Crekel, W. H. Anderson and J. W. Kirkpatrick disclosed a lighter-type burner recessed in a combustion chamber;

3,723,050, Mar. 27, 1973, granted to W. C. Stevens, Jr. and P. M. More disclosed a burner with an end closure having holes and open sides;

3,729,287 granted to O. T. Strashok on Apr. 24, 1973, disclosed an ignition torch with air-induction inlet and slotted coaxial tube shields.

However, because of complexity and expense of construction and, in some cases, lack of the knock-about-durability required in heavy industrial use, not one of the above types has become a widely used standard for the industry. Most existing natural gas lighter-torches are simply hose with a length of pipe affixed on the end. The free end of the pipe is, when used to ignite a zone burner, thrust into the burner port. Because forced air for combustion and steam also flows through burner ports, torch flames of natural gas, which is of very slow propagation characteristics, are sometimes lifted off burners, torches, etc. and frequently extinguished completely. This leaves a potentially hazardous situation of raw ignited gas flowing at a high rate into the furnace.

OBJECTS OF THE INVENTION

Principal objects of the invention therefore are to provide an efficient, practical, simple, rugged economical and stable torch that prevents flame lift-off, and prevents extinguishment and therefore explosion hazards whether by combustion air and steam flow, or by back pressure.

Further objects are to provide a torch as described which is easy to construct, using ordinary materials and methods and readily available tools.

Yet further objects are to provide a torch as described which is versatile, size adaptable, useful for many purposes, and which insures fuel-efficient combustion.

BRIEF SUMMARY OF THE INVENTION

In brief summary given as cursive description only and not as limitation, the invention includes a torch with capped-free-end slotted gas-receiving member separated by spacer baffles from a baffled-free-end slotted outer member having the end opposite the free end open for admission of combustion air.

BRIEF DESCRIPTION OF THE DRAWINGS

The above and other objects and advantages of this invention will become more readily apparent on examination of the following description.

DETAILED DESCRIPTION

Figures 1, 2:
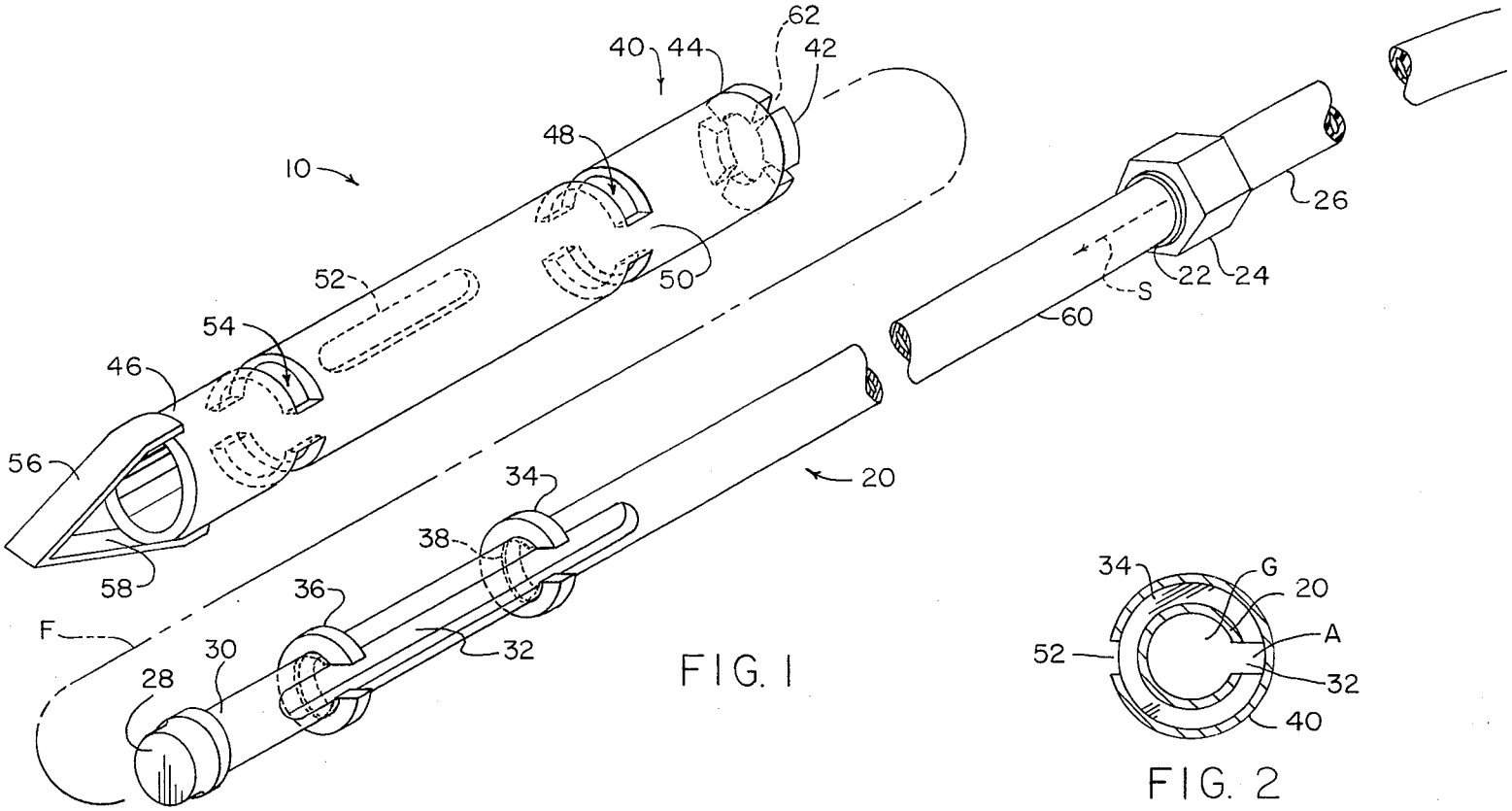
FIG. 1 is a partially exploded perspective view showing relations of the inner and outer tubes of the invention.
FIG. 2 is taken at 2—2, FIG. 3, and is a sectional view of the relation of the inner and outer tubes, slots and baffles, when assembled.

FIG. 1 shows the relations of the parts of the invention 10 in partially exploded view.

A first or inner pipe 20 may have a threaded butt end 22 proportioned for conventional nut-coupling 24 to a flexible hose 26 through which natural gas under pressure is supplied (arrow S) to this means for receiving gas.

Inner pipe 20 has a threaded cap 28 closing the second or free end 30 and a longitudinal gas expulsion slot 32 through the wall. Two circumferentially disposed "C"-shaped baffles 34, 36 with the openings in the "C"-shape coincident with the slot 32, are spaced apart longitudinally along the slot 32; these may be welded in place or may be held in snapring grooves 38 provided for the purpose in the exterior of the inner pipe 20, or both.

Second or outer pipe 40 fits over the first pipe 20 as indicated by broken lines F, and receives air inducted by flow of gas from the inner pipe along the baffled coaxial space between the inner and outer pipes. The inside diameter of the outer pipe 40 is just fit by the "C"-shaped baffles 34, 36 longitudinally spaced apart on the inner pipe 20, with the open part of the "C"-shape coincident with the slot 32 and one of said baffles located adjacently beyond each end of slot 52, and by the spacer blocks 42, on the outer pipe butt end 44 or end opposite the free end 46 of the outer pipe 40, an interrupted ring of welded-on arcuate blocks. The blocks can be welded also to the inner pipe 20 to hold the inner pipe in assembly with the outer pipe 40. One spacer block can be used like a "C"-shaped baffle welded on to the inner pipe, for example, but several are also suitable, welded-on last.

Forward of the butt end 44 of the outer pipe there are, in succession, a first vent 48 comprising a circumferential slot completely around the outer pipe, except that it is interrupted by relatively small supports 50 at 180°, leaving two "C" shaped, aligned openings; a longitudinal slot 52 on the side opposite slot 32 in the inner pipe 20 (these are preferably diammetrically opposed for efficiency in mixing) a second vent 54 like the first and a gable-roof-shaped flame spreader 56 symmetrically over the free end 46 of the outer pipe, but leaving an opening as at 58 to either side at the gable-end positions. The vent openings 48, 54 are beyond the respective ends of the longitudinal air-intake slot 52.

On assembly the first or inner pipe 20 butt end 22 extends free of the second or outer pipe 40 as a gas-flow-cooled handle portion 60 by which the free end can be thrust into a furnace port to light the furnace; the cap 28 lies within but free of the gable-roof-shaped structure 56 of the outer pipe 40; the slot in the outer pipe lies longitudinally between the "C"-shaped baffles 34, 36 which in turn lie between the vents 48, 54; the spacer blocks 42 engage the featureless handle grip portion 60 of the inner pipe 20.

In operation, gas under pressure flows through the inner pipe 20 and emerges along the slot 32 in the inner pipe, where it mixes with ambient air induced into the outer pipe 40 through the openings 62 between the spacer blocks 42 and through the vents 48, 54 and through slot 52 in the outer pipe, and turbulently mixed at baffles 34, 36 and cap 28, when ignited burns both within the coaxial space between the pipes and emerges at the gable ends (58 shown) of the gable-roof-shaped flame spreader 56 on the end of the outer pipe. One gable end opening may be sufficient but two of these lateral openings provide much greater insurance against back pressure problems that can occur with no guard over the open end when thrust against a wall or the like.

FIG. 2, a partial section, shows a relation insuring good mixing of gas G, which flows along inner pipe 20 and out slot 32, with air A which enters between spacer blocks and between inner pipe 20 and outer pipe 40. The ignited or preignited gas-air mixture than exhausts past "C"-shaped baffle 34 and the free end of the assembly through the flame spreader.

Figure 3:
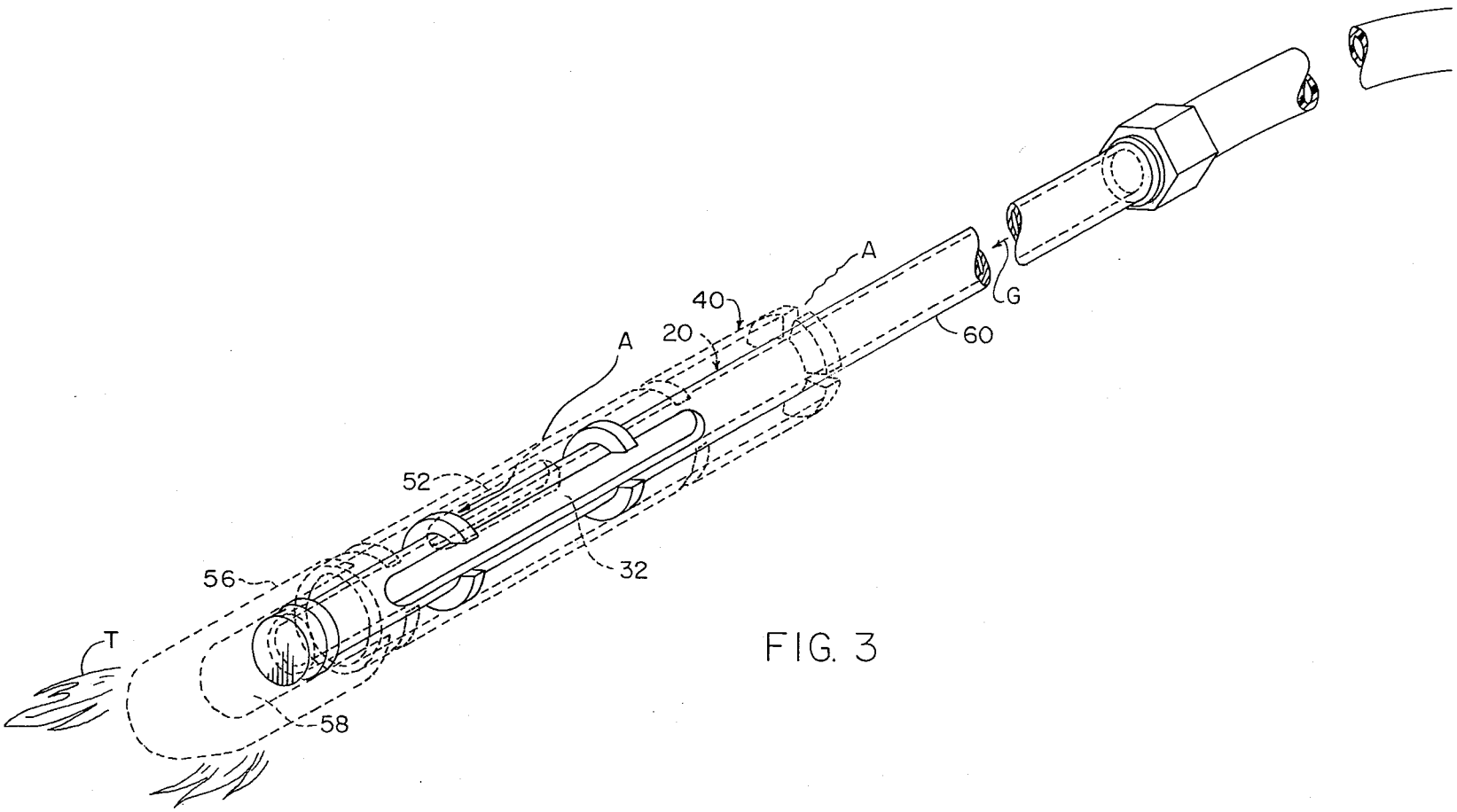
FIG. 3 is a perspective view of the invention assembled, with a slight modification of the flame spreader shape.

FIG. 3 shows the relations of the inner pipe 20 and outer pipe 40 when assembled, with torch flames T emerging from the protected interior combustion space at two points: the lateral openings (58 shown) of the flame spreader 56.

The inner pipe 20 may be of ¾ inch (1.8 cm) gas pipe 40 inches (1 m) long with a standard end-cap; the slot may be ⅜ inch by 12 inches (9 mm by 30 cm) and may end 1 inch (2.5 cm) from the cap.

The outer pipe may be of 1 ½ inch (3.7 cm) gas pipe 15 inches (37 cm) long. The slot in the outer pipe may be ⅜ inch by 4 inches (9 mm by 10 cm) and may extend to a point substantially equal to the butt-end position of the slot in the inner sleeve.

The circumferential vent slots may be 1 inch long by ⅛ inch wide (2.5 cm by 3 mm) and may be symmetrically spaced relative to the ends of the slot in the outer pipe and 1 inch farther apart. The flame spreader may be of ⅛ inch angle iron with 2 inch by 2 inch legs (3 mm by 5 cm by 5 cm).

Fabrication may be by conventional pipe-threading, drilling and sawing and welding techniques.

Flow turbulence inside this invention may not be completely explainable, but it is efficient and makes the invention "hurricane proof", a very important advantage in a portable torch, for preventing industrial furnace explosions. The preferably diametrically opposed relations of the longitudinal slots 32, 52 is evidently important.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a torch for igniting industrial furnaces and the like and having means for receiving gas, means for receiving air, baffle means, and flame outlet means, the means for receiving gas including an inner pipe with a first end thereof proportioned for receiving gas as from a flexible hose and a second end thereof closed;

the means for receiving air comprising an outer pipe around the inner pipe with a space therebetween, said outer pipe having a free end and a butt end, and said flame outlet means comprising means for expulsion of burning gas-air mixture from said space including at least one opening at said free end of the outer pipe;

means for induction of ambient air into said space for mixing with and burning said gas, the improvement including:

the inner pipe having a gas-expulsion slot on a first side thereof opening within said space, said outer pipe butt-end and the exterior of said inner pipe defining an air intake opening therebetween, said outer pipe further including an air intake slot at a position opposite said gas expulsion slot in the inner pipe; the baffle means being spaced apart longitudinally in said space, the baffle means being "C"-shaped with the open part of the "C"-shape coincident with the gas expulsion slot in the inner pipe, the outer pipe having first and second vent openings circumferentially therearound in longitudinal spacing from each other, said first and second vent openings being respectively beyond the ends of said air intake slot in the outer pipe, and a flame spreader on the free end of said outer pipe.

2. In a torch as recited in claim 1, said position opposite the gas expulsion slot in the outer pipe relative to the gas expulsion slot in the inner pipe being a diametrically opposed position.

3. In a torch as recited in claim 1, a cap, said closed second end of the inner pipe being closed by the cap, said cap acting as a baffle within said flame spreader.

* * * * *